US010871092B2

(12) United States Patent
Ishikawa

(10) Patent No.: US 10,871,092 B2
(45) Date of Patent: Dec. 22, 2020

(54) BLOW-BY GAS TREATMENT DEVICE FOR INTERNAL COMBUSTION ENGINE

(71) Applicant: TOYOTA JIDOSHA KABUSHIKI KAISHA, Toyota (JP)

(72) Inventor: Masami Ishikawa, Aichi-gun (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 37 days.

(21) Appl. No.: 16/240,837

(22) Filed: Jan. 7, 2019

(65) Prior Publication Data

US 2019/0234262 A1 Aug. 1, 2019

(30) Foreign Application Priority Data

Feb. 1, 2018 (JP) ..... 2018-016486

(51) Int. Cl.

| | |
|---|---|
| ***F01M 13/02*** | (2006.01) |
| ***F02M 25/06*** | (2016.01) |
| ***F02B 75/22*** | (2006.01) |
| ***F02M 35/10*** | (2006.01) |

(52) U.S. Cl.

CPC ..... *F01M 13/021* (2013.01); *F02B 75/22* (2013.01); *F02M 25/06* (2013.01); *F02M 35/1038* (2013.01); *F02M 35/10222* (2013.01); *F01M 2013/026* (2013.01)

(58) Field of Classification Search

CPC ..... F01M 13/021; F01M 2013/026; F02B 75/22; F02M 25/06; F02M 35/10222; F02M 35/1038

USPC ..... 123/572

See application file for complete search history.

(56) References Cited

U.S. PATENT DOCUMENTS

| | | | | |
|---|---|---|---|---|
| 4,721,090 | A * | 1/1988 | Kato | |
| 6,098,603 | A | 8/2000 | Maegawa et al. | |
| 6,247,464 | B1 | 6/2001 | Maegawa et al. | |
| 2001/0010214 | A1 | 8/2001 | Maegawa et al. | |
| 2015/0090204 | A1* | 4/2015 | Pursifull | F02B 33/00 123/41.86 |
| 2017/0175662 | A1* | 6/2017 | Yoshioka | F02D 41/22 |
| 2018/0209385 | A1* | 7/2018 | Berner | F02M 35/1038 |

FOREIGN PATENT DOCUMENTS

| | | |
|---|---|---|
| JP | 3-172524 | 7/1991 |
| JP | 10-184336 | 7/1998 |

OTHER PUBLICATIONS

Office Action dated Sep. 2, 2020, in corresponding Chinese Patent Application No. 201910022903.2.

* cited by examiner

*Primary Examiner* — Joseph J Dallo
*Assistant Examiner* — Yi-Kai Wang
(74) *Attorney, Agent, or Firm* — Oblon, McClelland, Maier & Neustadt, L.L.P.

(57) ABSTRACT

A blow-by gas treatment device includes a first blow-by gas pipe, a second blow-by gas pipe, a first pipe joint located on a first head cover, the first blow-by gas pipe being connected to the first pipe joint, a second pipe joint located on a second head cover, the second blow-by gas pipe being connected to the second pipe joint, a first union located on the first pipe joint, a second union located on the second pipe joint, and a pressure sensor connected to the first pipe joint by the first union and connected to the second pipe joint by the second union.

4 Claims, 3 Drawing Sheets

BLOW-BY GAS TREATMENT DEVICE FOR INTERNAL COMBUSTION ENGINE

BACKGROUND

1. Field

The present disclosure relates to a blow-by gas treatment device for an internal combustion engine.

2. Description of Related Art

Blow-by gas that has leaked from the combustion chamber of an internal combustion engine into the crankcase flows through a communication passage extending across the cylinder block and the cylinder head into a space defined by the cylinder head and the head cover. Japanese Laid-Open Patent Publication No. 10-184336 describes a blow-by gas treatment device for an internal combustion engine that causes blow-by gas that has flowed into a head cover to flow back into an intake pipe through a blow-by gas passage connected to the head cover and the intake pipe.

In the blow-by gas treatment device of the above-described document, the blow-by gas passage includes a blow-by gas valve. Further, a pressure sensor that detects the pressure in the blow-by gas passage is connected to a part of the blow-by gas passage between a portion connected to the intake pipe and the blow-by gas valve.

Conventionally, some internal combustion engines include passages through which blow-by gas flows back into the intake pipe. An internal combustion engine including banks, for example, an internal combustion engine having a V-type cylinder arrangement, includes head covers each provided for the corresponding bank. Thus, this internal combustion engine includes a first passage and a second passage through which blow-by gas in a first head cover and a second head cover of the head covers flows back into the intake pipe. When the above-described blow-by gas treatment device is applied to such an internal combustion engine including passages, the same number of pressure sensors as the passages is required to monitor the pressure in each passage. This will increase the number of pressure sensors.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A blow-by gas treatment device that solves the above-described problem includes blow-by gas pipes configured to cause blow-by gas in a space defined by a cylinder head and a head cover in an internal combustion engine to flow back into an intake pipe. The blow-by gas pipes include a first blow-by gas pipe connected to the intake pipe and a second blow-by gas pipe connected to a part of the intake pipe that differs from a part of the intake pipe connected to the first blow-by gas pipe. The blow-by gas treatment device includes a first pipe joint located on the head cover, the first blow-by gas pipe being connected to the first pipe joint, a second pipe joint located on the head cover, the second blow-by gas pipe being connected to the second pipe joint, a first union located on the first pipe joint, an inside of the first union communicating with an inside of the first pipe joint, a second union located on the second pipe joint, an inside of the second union communicating with an inside of the second pipe joint, and a pressure sensor connected to the first pipe joint by the first union and connected to the second pipe joint by the second union.

Other features, aspects, and advantages will become apparent from the following description, taken in conjunction with the accompanying drawings, and the claims.

DETAILED DESCRIPTION

Figure 1:
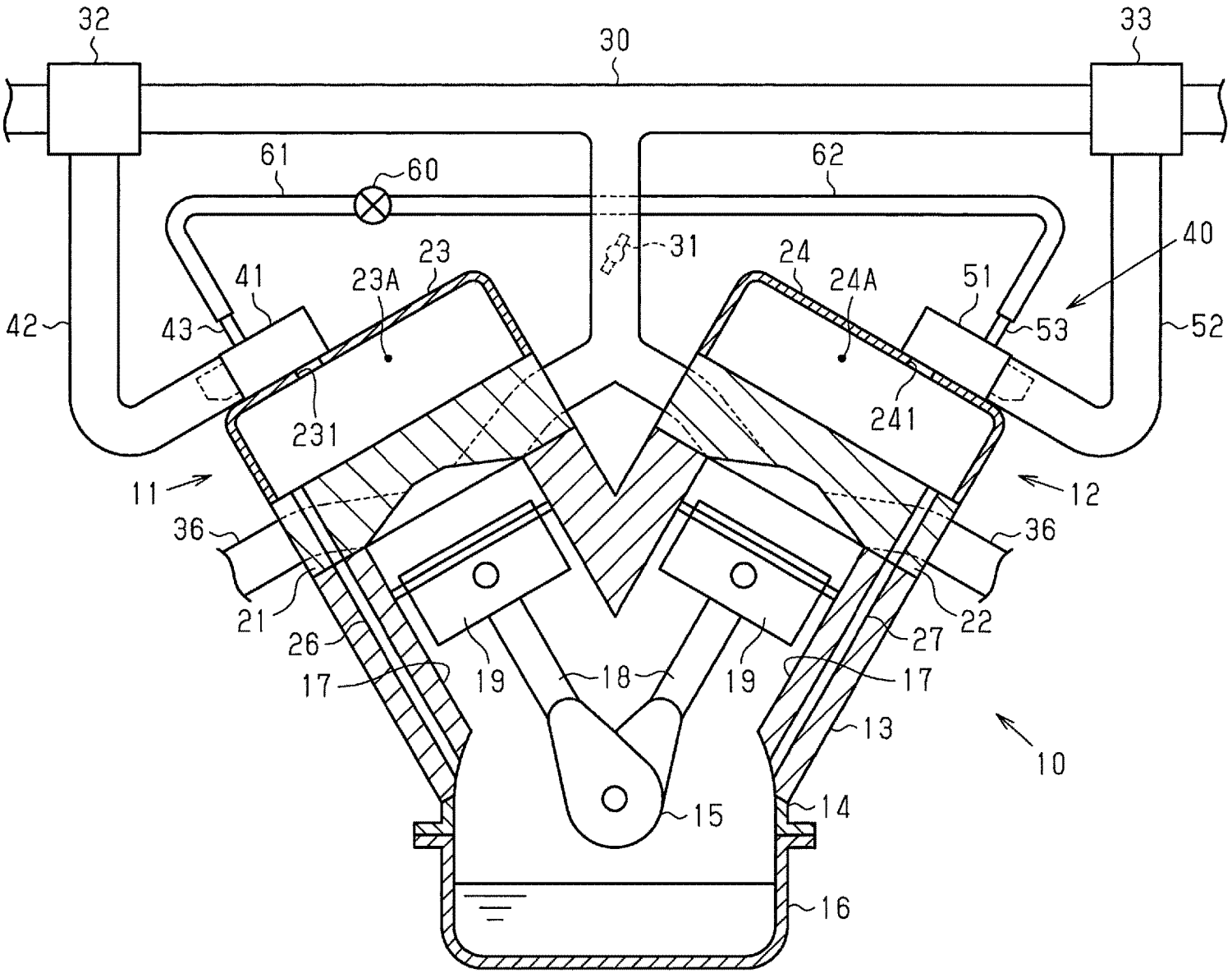
FIG. 1 is a cross-sectional view schematically showing an internal combustion engine that includes a blow-by gas treatment device according to a first embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Unless indicated otherwise, a statement that a first layer is "on" or "connected to" a second layer or a substrate is to be interpreted as covering both a case where the first layer directly contacts the second layer or the substrate, and a case where one or more other layers are disposed between the first layer and the second layer or the substrate.

Words describing relative spatial relationships, such as "below", "beneath", "under", "lower", "bottom", "above", "over", "upper", "top", "left", and "right", may be used to conveniently describe spatial relationships of one device or elements with other devices or elements. Such words are to be interpreted as encompassing a device oriented as illustrated in the drawings, and in other orientations in use or operation. For example, an example in which a device includes a second layer disposed above a first layer based on the orientation of the device illustrated in the drawings also encompasses the device when the device is flipped upside down in use or operation.

First Embodiment

A blow-by gas treatment device for an internal combustion engine according to a first embodiment will now be described with reference to FIGS. 1 and 2.

FIG. 1 shows an internal combustion engine 10 including a blow-by gas treatment device 40 of the present embodiment. The internal combustion engine 10 is an internal combustion engine of a V-type cylinder arrangement including two banks, namely, a first bank 11 and a second bank 12. A crankcase 14 is attached to the lower part of a cylinder block 13 of the internal combustion engine 10. The crankcase 14 accommodates a crankshaft 15. An oil pan 16 is attached to the crankcase 14. The oil pan 16 stores oil that circulates in the internal combustion engine 10.

The cylinder block 13 houses a cylinder 17 corresponding to the first bank 11 and a cylinder 17 corresponding to the second bank 12. The cylinders 17 each accommodates a piston 19 coupled to the crankshaft 15 by a connecting rod 18. Reciprocation of each piston 19 in the corresponding cylinder 17 rotates the crankshaft 15.

A first cylinder head 21 corresponding to the first bank 11 and a second cylinder head 22 corresponding to the second bank 12 are attached to the cylinder block 13. An intake pipe 30 through which intake air drawn into the cylinders 17 flows is connected to each of the first and second cylinder heads 21 and 22. An exhaust pipe 36 through which exhaust gas discharged out of the cylinders 17 flows is connected to each of the first and second cylinder heads 21 and 22.

A first head cover 23 is attached to the first cylinder head 21. The first cylinder head 21 and the first head cover 23 define a first cover inner space 23A. A second head cover 24 is attached to the second cylinder head 22. The second cylinder head 22 and the second head cover 24 define a second cover inner space 24A.

The internal combustion engine 10 includes a first communication passage 26 through which the inside of the crankcase 14 communicates with the inside of the first cover inner space 23A and a second communication passage 27 through which the inside of the crankcase 14 communicates with the inside of the second cover inner space 24A. The first communication passage 26 extends across the cylinder block 13 and the first cylinder head 21. The second communication passage 27 extends across the cylinder block 13 and the second cylinder head 22. Blow-by gas that has leaked out of the cylinders 17 into the crankcase 14 flows into the first cover inner space 23A through the first communication passage 26. Further, blow-by gas in the crankcase 14 flows into the second cover inner space 24A through the second communication passage 27.

The intake pipe 30 houses a throttle valve 31. The intake pipe 30 includes two branching passages located on the intake downstream side of the throttle valve 31. The two branching passages connect to the banks 11, 12, respectively. Further, the intake pipe 30 includes a first air cleaner 32 and a second air cleaner 33 located on the intake upstream side of the throttle valve 31.

The blow-by gas treatment device 40 will now be described with reference to FIGS. 1 and 2.

The blow-by gas treatment device 40 includes a first pipe joint 41 located on the first head cover 23 and a first blow-by gas pipe 42 connected to the distal end of the first pipe joint 41. The first pipe joint 41 may be integrated with the first head cover 23. The first blow-by gas pipe 42 is connected to the first head cover 23 by the first pipe joint 41. The basal end of the first pipe joint 41 is connected to a through-hole 231 extending through the first head cover 23. The inside of the first pipe joint 41 communicates with the first cover inner space 23A through the through-hole 231. That is, the basal end of the first pipe joint 41 corresponds to the upstream end of the first pipe joint 41 in a direction in which blow-by gas flows. The distal end of the first pipe joint 41 corresponds to the downstream end of the first pipe joint 41 in the flowing direction of blow-by gas flows.

A first end of the first blow-by gas pipe 42 is connected to the distal end of the first pipe joint 41. A second end of the first blow-by gas pipe 42 is connected to a portion of the intake pipe 30 located on the intake upstream side of the throttle valve 31. More specifically, the second end of the first blow-by gas pipe 42 is connected to the first air cleaner 32, which is located on the intake pipe 30. Blow-by gas that has flowed into the first cover inner space 23A flows through the first pipe joint 41 into the first blow-by gas pipe 42 and flows through the first blow-by gas pipe 42 back into the first air cleaner 32, that is, into the intake pipe 30.

Further, the blow-by gas treatment device 40 includes a second pipe joint 51 located on the second head cover 24 and a second blow-by gas pipe 52 connected to the distal end of the second pipe joint 51. The second pipe joint 51 may be integrated with the second head cover 24. The second blow-by gas pipe 52 is connected to the second head cover 24 by the second pipe joint 51. The basal end of the second pipe joint 51 is connected to a through-hole 241 extending through the second head cover 24. The inside of the second pipe joint 51 communicates with the second cover inner space 24A through the through-hole 241. That is, the basal end of the second pipe joint 51 corresponds to the upstream end of the second pipe joint 51 in the flow direction of blow-by gas. The distal end of the second pipe joint 51 corresponds to the downstream end of the second pipe joint 51 in the flowing direction of blow-by gas flows.

A first end of the second blow-by gas pipe 52 is connected to the distal end of the second pipe joint 51. A second end of the second blow-by gas pipe 52 is connected to a part of the intake pipe 30 that differs from the part of the intake pipe 30 connected to the first blow-by gas pipe 42 in the portion of the intake pipe 30 located on the intake upstream side of the throttle valve 31. More specifically, the second end of the second blow-by gas pipe 52 is connected to the second air cleaner 33, which configures the intake pipe 30. Blow-by gas that has flowed into the second cover inner space 24A flows through the second pipe joint 51 into the second blow-by gas pipe 52 and flows through the second blow-by gas pipe 52 back into the second air cleaner 33, that is, into the intake pipe 30.

Figure 2:
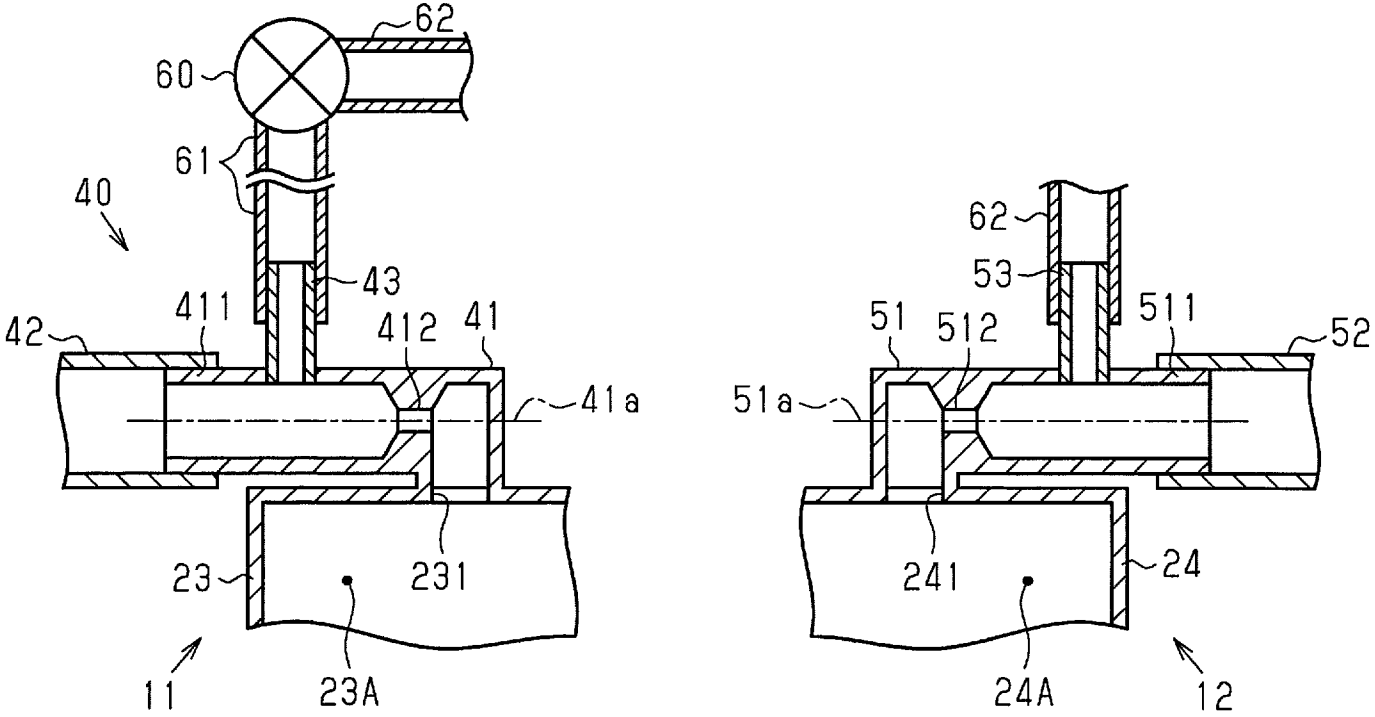
FIG. 2 is a cross-sectional view showing part of the blow-by gas treatment device of FIG. 1.

As shown in FIG. 2, the distal end (left end in FIG. 2) of the first pipe joint 41 is a connection portion 411 to which the first blow-by gas pipe 42 is connected. Further, a tubular first union 43 is connected to a part of the first pipe joint 41 located closer to the basal end than the connection portion 411 (right side of the connection portion 411 in FIG. 2), that is, a part between the distal end and the basal end. The part of the first pipe joint 41 connected to the first union 43 is located above a center axis 41*a* of the first pipe joint 41. The inside of the first union 43 communicates with the inside of the first pipe joint 41. The first union 43 extends upward from where the first pipe joint 41 is connected. Additionally, a constriction 412 that has a smaller cross-sectional flow area in the first pipe joint 41 than other sections is provided at a part of the first pipe joint 41 located closer to the basal end than the connected part of the first union 43, that is, a part between the connected part of the first union 43 and the basal end.

The distal end (right end in FIG. 2) of the second pipe joint 51 is a connection portion 511 to which the second blow-by gas pipe 52 is connected. Further, a tubular second union 53 is connected to a part of the second pipe joint 51 located closer to the basal end than the connection portion 511 (right side of the connection portion 511 in FIG. 2), that is, a part between the distal end and the basal end. The part of the second pipe joint 51 connected to the second union 53 is located above a center axis 51*a* of the second pipe joint 51. The inside of the second union 53 communicates with the inside of the second pipe joint 51. The second union 53 extends upward from where the second pipe joint 51 is connected. Additionally, a constriction 512 that has a smaller cross-sectional flow area in the second pipe joint 51 than other sections is provided at a part of the second pipe joint 51 located closer to the basal end than the connected part of the second union 53, that is, a part between the connected part of the second union 53 and the basal end.

Further, as shown in FIGS. 1 and 2, the blow-by gas treatment device 40 includes a pressure sensor 60. The pressure sensor 60 is located above the first pipe joint 41 and the second pipe joint 51. The pressure sensor 60 is connected to the first union 43 by a first connection pipe 61 and connected to the second union 53 by a second connection pipe 62. Thus, the pressure sensor 60 is capable of monitoring the pressure in the first pipe joint 41 and the first blow-by gas pipe 42 via the first connection pipe 61 and the first union 43. In the same manner, the pressure sensor 60 is capable of monitoring the pressure in the second pipe joint 51 and the second blow-by gas pipe 52 via the second connection pipe 62 and the second union 53.

The operation and advantages of the present embodiment will now be described.

Since the pressure sensor 60 is connected to the first pipe joint 41 by the first union 43, the pressure sensor 60 can detect the pressure in a region of the first pipe joint 41 located between the constriction 412 and the distal end and the pressure in the first blow-by gas pipe 42. In addition, since the pressure sensor 60 is also connected to the second pipe joint 51 by the second union 53, the pressure sensor 60 can detect the pressure in a region of the second pipe joint 51 located between the constriction 512 and the distal end and the pressure in the second blow-by gas pipe 52. That is, the pressure sensor 60 is shared to detect the pressure in the first blow-by gas pipe 42 and the pressure in the second blow-by gas pipe 52. This allows for monitoring of the pressure in the blow-by gas pipes 42, 52 while limiting increases in the number of pressure sensors.

When the engine is running, since blow-by gas flows through the blow-by gas pipes 42, 52 back into the intake pipe 30, the inside of the blow-by gas pipes 42, 52 and the region in the first pipe joints 41, 51 between the constrictions 412, 512, and the distal ends have negative pressure. In such a situation, when the first blow-by gas pipe 42 comes off from the first pipe joint 41, the region (first detection region) in the first pipe joint 41 between the constriction 412 and the distal end is exposed to the atmosphere. Thus, the pressure of the first detection region changes from negative pressure toward atmospheric pressure. Such a pressure change in the first detection region is detected by the pressure sensor 60. This allows the pressure sensor 60 to detect coming-off of the first blow-by gas pipe 42 from the first pipe joint 41 based on the pressure change in the region of the first pipe joint 41 between the first constriction 412 and the distal end, which is detected by the pressure sensor 60.

Further, when the second blow-by gas pipe 52 comes off from the second pipe joint 51, the region (second detection region) in the second pipe joint 51 between the constriction 512 and the distal end is exposed to the atmosphere. Thus, the pressure of the second detection region changes from negative pressure toward atmospheric pressure. Such a pressure change in the second detection region is detected by the pressure sensor 60. This allows the pressure sensor 60 to detect coming-off of the second blow-by gas pipe 52 from the second pipe joint 51 based on the pressure change in the region of the second pipe joint 51 between the second constriction 512 and the distal end, which is detected by the pressure sensor 60.

Oil that remains in the cover inner spaces 23A, 24A may enter the pipe joints 41, 51. Oil may also enter the unions 43, 53 from the pipe joints 41, 51. In the present embodiment, the unions 43, 53 extend upward from the pipe joints 41, 51. Thus, even if oil enters the unions 43, 53, the oil is less likely to collect on the pressure sensor 60. In short, the collection of oil on the pressure sensor 60 is limited by means of gravitational force.

Additionally, the unions 43, 53 are connected to the parts of the pipe joints 41, 51 located above the center axes 41*a*, 51*a*. This limits entry of oil from the pipe joints 41, 51 into the unions 43, 53. Thus, the effect of limiting collection of oil on the pressure sensor 60 is further increased.

Second Embodiment

A blow-by gas treatment device according to a second embodiment will now be described with reference to FIG. 3. The second embodiment differs from the first embodiment in the structure of an internal combustion engine including a blow-by gas treatment device. The following description focuses on the parts that differ from the first embodiment, and like or same reference numerals are given to those components that are the same as the corresponding components of the first embodiment. Such components will not be described in detail.

Figure 3:
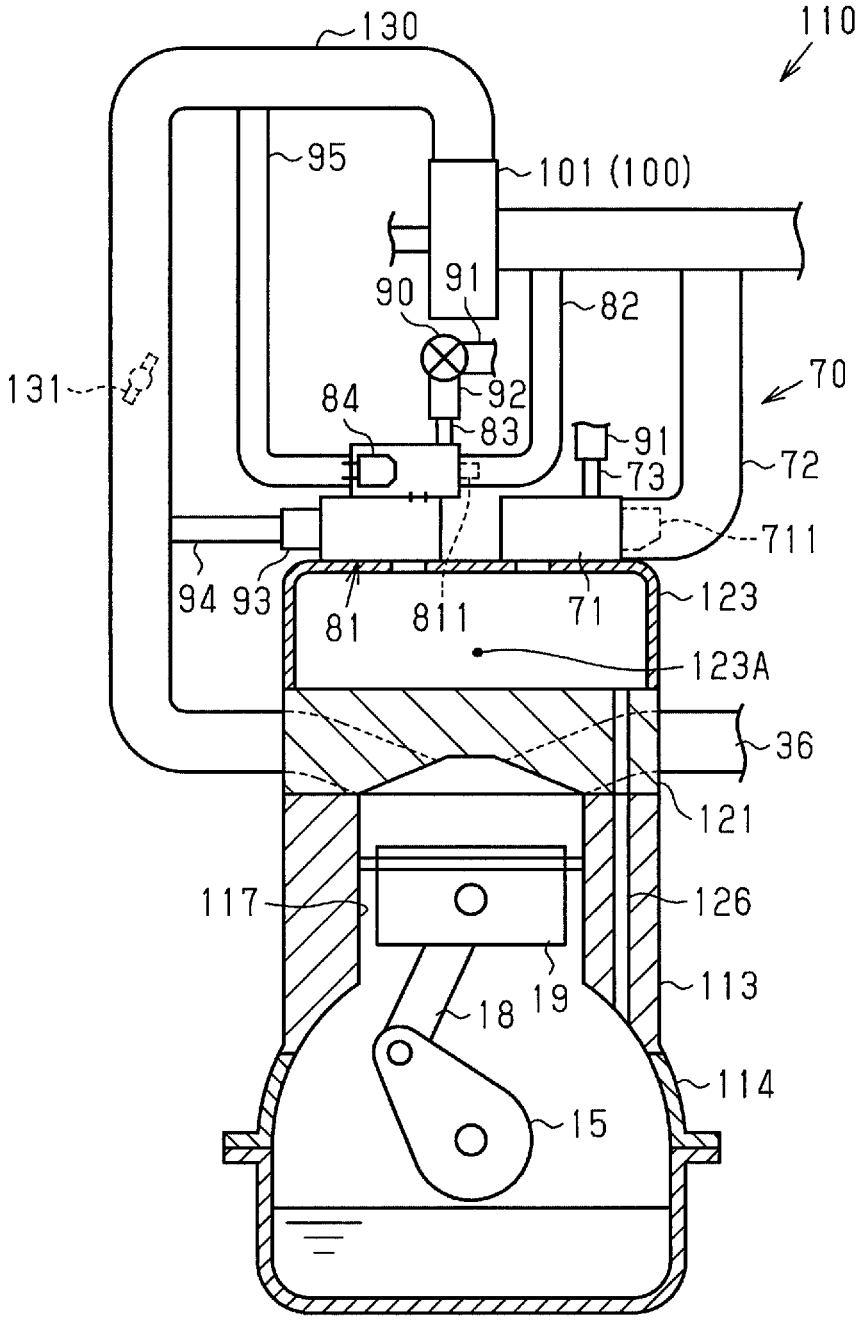
FIG. 3 is a cross-sectional view schematically showing an internal combustion engine that includes a blow-by gas treatment device according to a second embodiment.

FIG. 3 shows an internal combustion engine 110 that is an internal combustion engine of an inline N-cylinder in which cylinders 117 are arranged in a predetermined direction. N refers to an integer greater than or equal to two. The internal combustion engine 110 includes a cylinder block 113. A cylinder head 121 is attached to the upper part of the cylinder block 113. A head cover 123 is attached to the cylinder head 121. The cylinder head 121 and the head cover 123 define a cover inner space 123A. The cover inner space 123A communicates with the inside of a crankcase 114 through a communication passage 126 that extends across the cylinder block 113 and the cylinder head 121. Thus, blow-by gas flows from the crankcase 114 through the communication passage 126 into the cover inner space 123A.

As shown in FIG. 3, a blow-by gas treatment device 70 of the present embodiment includes two pipe joints 71, 81, namely, a first pipe joint 71 and a second pipe joint 81 located on the head cover 123. The first pipe joint 71 is connected by a first blow-by gas pipe 72 to a part of an intake pipe 130 located on the intake upstream side of a throttle valve 131, more specifically, the part of the intake pipe 130 located on the intake upstream side of a compressor 101 of a forced induction device 100.

The distal end (right end in FIG. 3) of the first pipe joint 71 is a connection portion 711 to which the first blow-by gas pipe 72 is connected. A tubular first union 73 is connected to a part of the first pipe joint 71 located closer to the basal end than the connection portion 711 (left side of the connection portion 711 in FIG. 3), that is, a part of the first pipe joint 71 between the distal end and the basal end. That is, the inside of the first union 73 communicates with the inside of the first pipe joint 71. The first union 73 extends upward from where the first pipe joint 71 is connected. A first connection pipe 91 is connected to the upper end of the first union 73, and a pressure sensor 90 is connected to the first connection pipe 91. This allows the pressure sensor 90 to detect the pressure in the first blow-by gas pipe 72 and the pressure in the first pipe joint 71.

A downstream pipe 94 is connected to the second pipe joint 81 by a positive crankcase ventilation (PCV) valve 93. The downstream pipe 94 is connected to a part of the intake pipe 130 located on the intake downstream side of the throttle valve 131. Further, the second pipe joint 81 includes an ejector 84, and an ejector connection pipe 95 is connected to the ejector 84. The ejector connection pipe 95 is connected to a part of the intake pipe 130 between the compressor 101 and the throttle valve 131.

Further, a second blow-by gas pipe 82 is connected to the second pipe joint 81. More specifically, the second blow-by gas pipe 82 is connected to a part of the second pipe joint 81 located on the downstream side in the flow direction of a high-speed fluid that is output from the ejector 84. Thus, action of the ejector 84 causes a large amount of blow-by gas to flow into the second blow-by gas pipe 82. The second blow-by gas pipe 82 is connected to a part of the intake pipe 130 located on the intake upstream side of the compressor 101.

The portion of the second pipe joint 81 connected to the second blow-by gas pipe 82 is a connection portion 811. A tubular second union 83 is connected to a part of the second pipe joint 81 between the ejector 84 and the connection portion 811. That is, the inside of the second union 83 communicates with the inside of the second pipe joint 81. The second union 83 extends upward from where the second pipe joint 81 is connected. A second connection pipe 92 is connected to the upper end of the second union 83, and the pressure sensor 90 is connected to the second connection pipe 92. This allows the pressure sensor 90 to detect the pressure in the second blow-by gas pipe 82 and the pressure in the second pipe joint 81.

The operation and advantages of the present embodiment will now be described.

Since the pressure sensor 90 is connected to the first pipe joint 71 by the first union 73, the pressure sensor 90 can detect the pressure in the first pipe joint 71 and the pressure in the first blow-by gas pipe 72. In addition, since the pressure sensor 90 is also connected to the second pipe joint 81 by the second union 83, the pressure sensor 90 can detect the pressure in the second pipe joint 81 and the pressure in the second blow-by gas pipe 82. That is, the pressure sensor 90 is shared to detect the pressure in the first blow-by gas pipe 72 and the pressure in the second blow-by gas pipe 82. This allows for monitoring of the pressure in the blow-by gas pipes 72, 82 while limiting increases in the number of pressure sensors.

It should be apparent to those skilled in the art that the present invention may be embodied in many other specific forms without departing from the spirit or scope of the invention. Particularly, it should be understood that the present invention may be embodied in the following forms.

The unions 43, 53, 73, 83 may be respectively connected to the pipe joints 41, 51, 71, 81 such that the unions 43, 53, 73, 83 extend in a direction intersecting the vertical direction. Even such a structure allows the pressure sensors 60, 90 to be located above the parts of the pipe joints 41, 51, 71, 81 connected to the unions 43, 53, 73, 83.

The pressure sensor 60 does not have to be located above the parts of the pipe joints 41, 51 connected to the unions 43, 53, and the pressure sensor 90 does not have to be located above the parts of the pipe joints 71, 81 connected to the unions 73, 83. For example, the pressure sensor 60 may be located at the same height as the parts of the pipe joints 41, 51 connected to the unions 43, 53, and the pressure sensor 90 may be located in the vertical direction at the same part as the parts of the pipe joints 71, 81 connected to the unions 73, 83. Alternatively, the pressure sensor 60 may be located below the parts of the pipe joints 41, 51 connected to the unions 43, 53, and the pressure sensor 90 may be located below the parts of the pipe joints 71, 81 connected to the unions 73, 83.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

The invention claimed is:

1. A blow-by gas treatment device comprising:

blow-by gas pipes configured to cause blow-by gas in a space defined by a cylinder head and a head cover in an internal combustion engine to flow back into an intake pipe, the blow-by gas pipes including a first blow-by gas pipe connected to the intake pipe, and a second blow-by gas pipe connected to a part of the intake pipe that differs from a part of the intake pipe connected to the first blow-by gas pipe;

a first pipe joint located on the head cover, wherein the first blow-by gas pipe is connected to the first pipe joint;

a second pipe joint located on the head cover, wherein the second blow-by gas pipe is connected to the second pipe joint;

a first union located on the first pipe joint, wherein an inside of the first union communicates with an inside of the first pipe joint;

a second union located on the second pipe joint, wherein an inside of the second union communicates with an inside of the second pipe joint; and a pressure sensor connected to the first pipe joint by the first union and connected to the second pipe joint by the second union;

a first connection pipe extending from the pressure sensor to the first union; and a second connection pipe extending from the pressure sensor to the second union.

2. The blow-by gas treatment device according to claim 1, wherein the internal combustion engine includes a first bank and a second bank, the cylinder head is one of a first cylinder head corresponding to the first bank and a second cylinder head corresponding to the second bank, the head cover is one of a first head cover attached to the first cylinder head and a second head cover attached to the second cylinder head, the first pipe joint is located on the first head cover, and the second pipe joint is located on the second head cover.

3. The blow-by gas treatment device according to claim 1, wherein each of the first pipe joint and the second pipe joint includes a basal end connected to the head cover and a constriction located closer to the basal end than the corresponding one of the first union and the second union.

4. The blow-by gas treatment device according to claim 1, wherein each of the first pipe joint and the second pipe joint includes a basal end connected to the head cover and a constriction located between the basal end and the corresponding one of the first union and the second union.

* * * * *